United States Patent [19]

Ross

[11] Patent Number: 5,029,847

[45] Date of Patent: Jul. 9, 1991

[54] FOLDABLE EXERCISE STICK

[76] Inventor: Helen Ross, 5407 Moss Grey La., Spring, Tex. 77373

[21] Appl. No.: 390,099

[22] Filed: Aug. 7, 1989

[51] Int. Cl.[5] ..... A63B 26/00

[52] U.S. Cl. ..... 272/93; 272/124; 273/84 R; 135/114

[58] Field of Search ..... 272/70, 93, 124; 273/84 R, 84 A; 135/106, 109, 114

[56] References Cited

U.S. PATENT DOCUMENTS 2,705,015 3/1955 Langlais ..... 135/114 X 4,682,774 7/1987 Holy ..... 273/84 R

*Primary Examiner*—Richard J. Apley

*Assistant Examiner*—Joe H. Cheng

*Attorney, Agent, or Firm*—Kenneth D. Baugh

[57] ABSTRACT

A foldable exercise stick 10 is provided for exercising. The foldable exercise stick includes a first elongated member 20 having an aperture 28 extending therethrough and an intermediate elongated member 22, 24 having an aperture 28 extending therethrough. A first coupling is provided for threadably coupling the intermediate elongated member 22 to extend longitudinally from the first elongated member 20. A second elongated member 26 having an aperture 28 extending therethrough is threadably coupled by a second coupling to extend longitudinally from the intermediate elongated member 24. The foldable exercise stick 10 also includes a third coupling 52 which extends through the apertures in the elongated members. The third coupling 52 is provided to loosely couple the elongated members 20, 22, 24 and 26 together when the first and second coupling are disengaged so that they may be aligned adjacent one another in a folded configuration when the stick is not in use.

3 Claims, 1 Drawing Sheet

FOLDABLE EXERCISE STICK

TECHNICAL FIELD

This invention relates to a exercise device and more particularly a foldable exercise stick for assisting users in exercising individual parts of the body. The need to stay physically fit is an ongoing concern. Because of this need and the ever growing popularity of physical fitness there is always a need to provide apparatus to assist in this endeavor. There have been a number of different developments to assist exercisers in their quest for physical fitness.

However, the ever growing concern is for devices that can be manipulated in a plurality of ways so as to isolate and provide conditioning for various individual parts of the body. Ideally this should be accomplishable with a single exercise device that is portable and that can be conveniently stored and easily carried from one place to another depending on the needs of the user.

BACKGROUND ART

Attempts have been made to provide devices which allow an individual to isolate and exercise specific body portions to the exclusion of others. On such device is disclosed in U.S. Pat. No. 4,518,162. This device is a weighted exercise bar which includes a pair of sections joined together at a moment resisting joint by means of a cam lock slot and pin. Additionally weights are coupled to each end of the bar. Another arrangement is disclosed in U.S. Pat. No. 3,554,539. This arrangement is a lightweight metal rod which is intended to be manually held at opposite ends while being jumped over by the holder. The ends are in the form of handles which may be moved and adjusted depending on the desired jumping height of the user. These devices do provide means for exercising desired body parts, however, there still remains a need for a single exercise device that is simple in its construction, portable, conveniently storable and easily carried from one place to another as desired by the user.

DISCLOSURE OF THE INVENTION

A foldable exercise stick is provided for exercising. The foldable exercise stick includes a first elongated member having an aperture extending therethrough and an intermediate elongated member having an aperture extending therethrough. A first coupling means is provided for threadably coupling the intermediate elongated member to extend longitudinally from the first elongated member. A second elongated member having an aperture extending therethrough is threadably coupled by a second coupling means to extend longitudinally from the intermediate elongated member. The foldable exercise stick also includes a third coupling means, which extends through the apertures in the elongated members. The third coupling means is provided to loosely couple the elongated members together when the first and second coupling members are disengaged so that they may be aligned adjacent one another in a folded configuration when the stick is not in use.

BRIEF DESCRIPTION OF THE DRAWING

The details of the invention will be described in connection with the accompanying drawing in which.

BEST MODE FOR CARRYING OUT THE INVENTION

Figure 1:
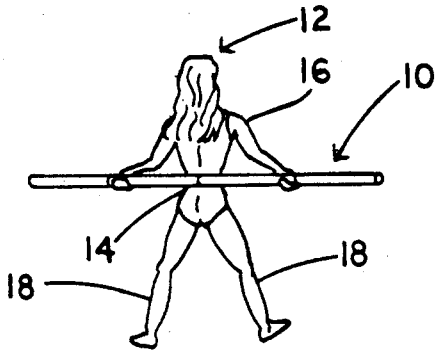
FIG. 1 is a front view illustrating an exercise position of an exerciser utilizing a foldable exercise stick in accordance with the principles of this invention.

Referring to FIG. 1 there is shown a Foldable Exercise Stick, generally designated by the numeral, 10 which is used by a exerciser, generally designated by the numeral, 12. The foldable exercise stick 10 is provided to facilitate the conditioning of various parts of the exerciser's body, such as, for example, the waist 14, arms 16 and legs 18.

Figure 2:
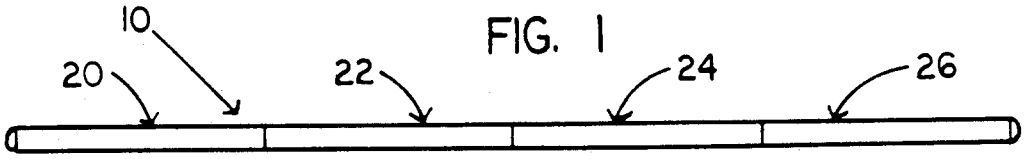
FIG. 2 is a side view illustrating the Foldable Exercise Stick in accordance with the principles of this invention.
Figure 4:
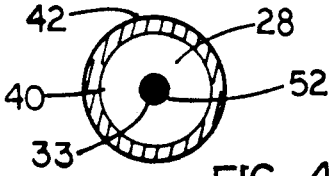
FIG. 4 is a sectional view illustrating the Foldable Exercise Stick in accordance with the principles of this invention taken along lines 4—4 of FIG. 3.
Figure 5:
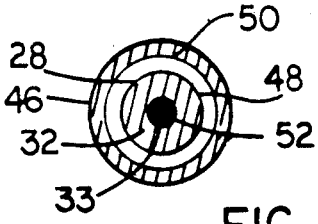
FIG. 5 is a sectional view illustrating the Foldable Exercise Stick in accordance with the principles of this invention taken along lines 5—5 of FIG. 3.

As illustrated in FIG. 2 the foldable exercise stick 10 is provided with a plurality of interlocking exercise members, generally designated by the numerals, 20, 22, 24 and 26 respectively. Each exercise member 20, 22, 24 and 26 is formed with a longitudinal aperture 28 extending therethrough (FIGS. 4,5). The end exercise members 20 and 26 have a circularly configured support member 32 aligned in the aperture 28 and spaced from the ends 30. The circularly configured support members 32 each have an aperture 33 formed therethrough.

A cap, generally designated by the numeral, 34 is provided to fit in the end exercise members 20 and 26 in the aperture 28 at each end 30 of the end exercise members. Each cap 34 includes an upper portion 36 having dimensions slightly larger than the aperture 28. This allows the cap 34 to cover the aperture as illustrated. The cap 34 is also provided with a lower portion 38 which has dimensions slightly smaller than the aperture 28. This allows the portion 38 to be force fit in the aperture 28 thereby allowing the cap 34 to be held securely in the each end 30 of end exercise members 20 and 26.

The end exercise member 20 and intermediate exercise members 22 and 24 are each formed with a plurality of internal threads 40. The threads 40 are formed in the aperture 28 at ends 42 of the exercise members 20, 22 and 24. The intermediate members 22 and 24 and the end exercise member 26 of the foldable exercise stick 10 are each formed with a coupling member 44. A coupling member 44 is coupled in the aperture 28 at an end 46 of each of the exercise members 22, 24 and 26. The coupling members 44 have an aperture 48 which extends therethrough and is aligned with the aperture 28. Each coupling member 44 is formed with a plurality of threads or abutments 50. The threads 50 of exercise member 22, 24 and 26 are provided to be screwed into the threads 40 of the adjacently aligned exercise members 20, 22 and 24. This allows the exercise members 20, 22, 24 and 26 to be threadedly coupled together to form the longitudinally extending exercise stick 10 illustrated in FIGS. 1 and 2.

Figure 3:
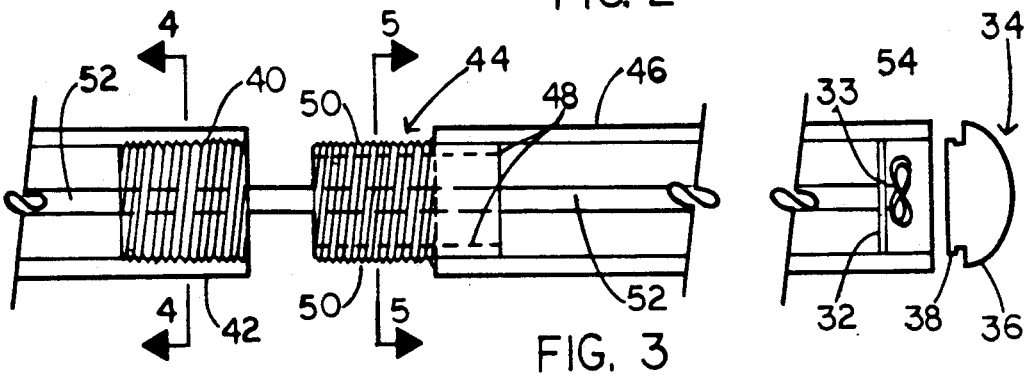
FIG. 3 is a sectional view illustrating the Foldable Exercise Stick in accordance with the principles of this invention.
Figure 6:
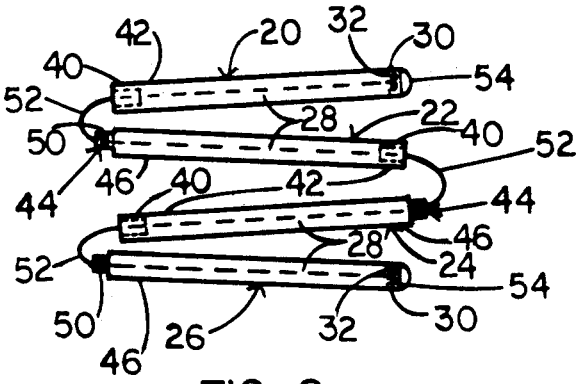
FIG. 6 is a side view illustrating the Foldable Exercise Stick in accordance with the principles of this invention in a partially folded configuration.

The foldable exercise stick 10 is also provided with a flexible member or cord 52 (FIGS. 3 and 6). The cord 52 is provided to be supported on the circularly configured support members 32 and extend through the apertures 28. The ends 54 of the cord are tied on the support members 32 so that the cord will be secured thereto. This will keep the cord 52 in place in the aperture 28. The cord 52 is slightly longer than the coupled exercise members 20, 22, 24 and 26. The cord 52 serves as a coupling member which allows the exercise members 20, 22, 24 and 26 to be held together in a folded configuration adjacent one another when the exercise members are not threadedly coupled (FIG. 6).

Figure 7:
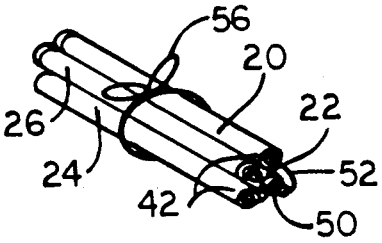
FIG. 7 is a perspective view illustrating the Foldable Exercise Stick in accordance with the principles of this invention in a fully folded configuration.

As illustrated in FIGS. 1 and 2 when the foldable exercise stick 10 is in use the exercise members 20, 22, 24, and 26 are threadedly coupled together by threads 40 and 50 so that the stick is in an extended position. The foldable exercise stick 10 can then be positioned about the desired part of the body so that the desired exercise can be accomplished. When the exercise routine is over the exercise members 20, 22, 24 and 26 are detached by unscrewing the threads 40 and 50. Because of the coupling action of the cord 52 which extends through the exercise members 20, 22, 24 and 26, the exercise members are loosely coupled when the exercise members are unscrewed. This allows the exercise members 20, 22, 24 and 26 to be folded as illustrated in FIGS. 6 and 7. Once the foldable exercise stick 10 is folded as desired a coupler or tie 56 can be secured thereon (FIG. 7) to maintain the stick in the desired folded configuration. The foldable exercise stick 10 can then be stored in a exercise bag of the user (not shown) and conveniently transported as desired by the user.

It should be understood that various changes and modifications can be made without departing from the spirit of the invention as defined in the claims.

What is claimed:

1. A foldable exercise stick including:

first elongated member having an aperture extending therethrough;

an intermediate elongated member means having an aperture extending therethrough;

first coupling means including a first means having a plurality of threads formed in an internal portion of an innermost end of the first elongated member and an aperture extending therethrough, and a second means having a plurality of threads formed on an external portion of an adjacent end of the intermediate elongated member means and an aperture extending therethrough, wherein the first means engaging the second means for threadably coupling the intermediate elongated member means to extend longitudinally from the first elongated member;

a second elongated member having an aperture extending therethrough;

second coupling means including a third means having a plurality of threads formed in an internal portion of an outermost end of the intermediate elongated member means and an aperture extending therethrough, and a fourth means having a plurality of threads formed on an external portion of an adjacent end of the second elongated member and an aperture extending therethrough, wherein the third means engaging the fourth means for threadably coupling the second elongated member to extend longitudinally from the intermediate elongated member means; and third coupling means, which is slightly longer than the coupled elongated members, wherein the third coupling means including a first support member mounted at the outer end of the first elongated member, a second support member mounted at the outer end of the second elongated member, and a cord extended through the apertures in the first elongated member, the second elongated member and the intermediate elongated member means, wherein one end of the cord is coupled to the first support member and the other end of the cord is coupled to the second support member for loosely coupling the first and second elongated members and the intermediate elongated member means together when the first and second coupling means are disengaged so that the first and second elongated members and the intermediate elongated member means are aligned adjacent one another in a folded configuration.

2. A foldable exercise stick as defined in claim 1 wherein the intermediate elongated member includes:

a first intermediate elongated member having an aperture formed therethrough;

a second intermediate elongated member having an aperture formed therethrough; and forth coupling means for coupling the second intermediate elongated member to extend longitudinally from the first intermediate elongated member.

3. A foldable exercise stick as defined in claim 1 wherein the first elongated member has a cap coupled in the outermost end thereof and the second elongated member has a cap coupled in the outermost end thereof.

* * * * *